US011203841B2

(12) United States Patent
Doy et al.

(10) Patent No.: US 11,203,841 B2
(45) Date of Patent: Dec. 21, 2021

(54) MACHINE, SYSTEM, AND METHOD FOR AUTOMATED MILLING EXIT CUT OPERATION

(71) Applicant: Caterpillar Paving Products Inc., Brooklyn Park, MN (US)

(72) Inventors: Nathaniel Doy, Maple Grove, MN (US); Jason W. Muir, Andover, MN (US); Lee M. Hogan, Champlin, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 78 days.

(21) Appl. No.: 16/837,348

(22) Filed: Apr. 1, 2020

(65) Prior Publication Data

US 2021/0310201 A1 Oct. 7, 2021

(51) Int. Cl.
*E01C 23/06* (2006.01)
*E01C 23/088* (2006.01)

(52) U.S. Cl.
CPC ..... *E01C 23/065* (2013.01); *E01C 23/088* (2013.01)

(58) Field of Classification Search
CPC ..... E01C 23/065; E01C 23/088
USPC ..... 404/84.05–84.5, 90–94; 299/1.05, 1.4, 299/1.5
See application file for complete search history.

(56) References Cited

U.S. PATENT DOCUMENTS

| | | | | |
|---|---|---|---|---|
| 8,485,755 | B2 | 7/2013 | Menzenbach et al. | |
| 8,605,393 | B2 * | 12/2013 | Jayanth | G01R 31/343 361/30 |
| 8,632,132 | B2 | 1/2014 | Menzenbach et al. | |
| 8,899,689 | B2 | 12/2014 | Killion | |
| 8,960,806 | B2 | 2/2015 | Wachsmann | |
| 9,864,347 | B2 | 1/2018 | Laux et al. | |
| 10,370,803 | B2 | 8/2019 | Berning et al. | |
| 10,465,347 | B2 | 11/2019 | Berning | |
| 10,829,899 | B2 * | 11/2020 | Sturos | E01C 23/088 |
| 2015/0330037 | A1 * | 11/2015 | Karsten | E01C 23/088 404/75 |
| 2016/0258119 | A1 | 9/2016 | Krolnik et al. | |
| 2020/0407928 | A1 * | 12/2020 | Berning | E01C 23/088 |
| 2021/0148066 | A1 * | 5/2021 | DeLong | E01C 23/06 |
| 2021/0189667 | A1 * | 6/2021 | Fritz | E01C 23/088 |
| 2021/0229516 | A1 * | 7/2021 | Engelmann | B60G 17/019 |
| 2021/0231139 | A1 * | 7/2021 | Engelmann | F15B 15/2838 |
| 2021/0238814 | A1 * | 8/2021 | Engelmann | B62D 55/065 |

FOREIGN PATENT DOCUMENTS

| | | |
|---|---|---|
| CN | 104032659 | 8/2016 |

* cited by examiner

*Primary Examiner* — Raymond W Addie
(74) *Attorney, Agent, or Firm* — Oblon, McClelland, Maier & Neustadt

(57) ABSTRACT

A milling machine, system, and method for implementing an exit cut operation raises a rotor from a state where the rotor contacts ground surface material responsive to a control input at an operator control interface of the milling machine. The rate at which the rotor is raised can increase as the rotor is raised. When the rotor is determined to have reached a top surface of the ground surface material the rotor can be raised at a maximum rate.

20 Claims, 7 Drawing Sheets

MACHINE, SYSTEM, AND METHOD FOR AUTOMATED MILLING EXIT CUT OPERATION

TECHNICAL FIELD

The present disclosure relates to automated operations for a milling machine, and more particularly to an automated exit cut operation for the milling machine.

BACKGROUND

Conventionally a milling machine, such as a rotary mixer or a cold planer, may leave an undesirable divot or pile of material at the end of a cutting pass.

U.S. Pat. No. 8,485,755 ("the '755 patent") describes that a controller for terminating the milling process controls the milling depth of a milling device along a specified trajectory in conjunction with simultaneous forward and reverse travel. According to the '755 patent, such control enables the milling device to be raised into an upper position disengaged from the ground without a depression resulting from raising the milling device remaining in the worked ground surface. However, the '755 patent is not understood to describe changing the speed at which the milling device is raised based on the position of the milling device relative to the worked ground surface.

SUMMARY OF THE DISCLOSURE

In one aspect, the present disclosure describes a method. The method, which can be implemented in a milling machine such as a rotary mixer or a cold planer, can comprise: raising, under control of control circuitry, a rotor of a milling machine from a state where the rotor contacts ground surface material responsive to a control input at an operator control interface of the milling machine; determining, using the control circuitry, when a bottom portion of the rotor has reached a top surface of the ground surface material based on signals from at least one sensor; and controlling, using the control circuitry, the raising of the rotor such that a rate at which the rotor is raised increases as the rotor is raised. The rate at which the rotor is raised can increase to a maximum rate when said determining determines that the bottom portion of the rotor has reached the top surface of the ground surface material.

In another aspect, the present disclosure implements or provides a milling system. The milling system can comprise a rotor of a milling machine configured to process ground surface material; a mixing chamber of the milling machine, the rotor being provided at least partially in the mixing chamber; and a controller of the milling machine configured to control an automated exit cut operation. The controller can be configured to: control the exit cut operation responsive to a control input at an operator control interface of the milling machine, the exit cut operation including raising the rotor from a state where the rotor contacts the ground surface material to a state where the rotor does not contact the ground surface material, determine when the rotor has reached a top surface of the ground surface material based on signals from at least one sensor, and control the raising of the rotor such that a rate at which the rotor is raised increases as the rotor is raised, the rotor being raised at a maximum rate when the controller determines that the rotor has reached the top surface of the ground surface material.

In yet another aspect a milling machine can be provided or implemented. The milling machine can comprise an operator control interface; a frame; a mixing chamber; a rotor configured to process ground surface material, the rotor being provided at least partially in the mixing chamber; a plurality of sensors; and a controller configured to control a plurality of legs of the milling machine and the rotor according to settings for an automated exit cut operation. The controller can be configured to: a controller configured to control a plurality of legs of the milling machine and the rotor according to settings for an automated exit cut operation, control the automated exit cut operation responsive to a control input at the operator control interface, the automated exit cut operation including raising the rotor to be fully inside the mixing chamber based on a speed of the milling machine, determine when the rotor has reached a top surface of the ground surface material based on signals from at least sensor of the plurality of sensors, and control the raising of the rotor such that the rotor is raised at a rate proportional to the speed of the milling machine, the rate at which the rotor is raised increasing as the rotor is raised, and the rotor being raised at a maximum rate when the controller determines that the rotor has reached the top surface of the ground surface material.

Other features and aspects of this disclosure will be apparent from the following description and the accompanying drawings.

DETAILED DESCRIPTION

The present disclosure relates to automated operations for a milling machine, and more particularly to an automated exit cut operation of the milling machine.

Figure 1:
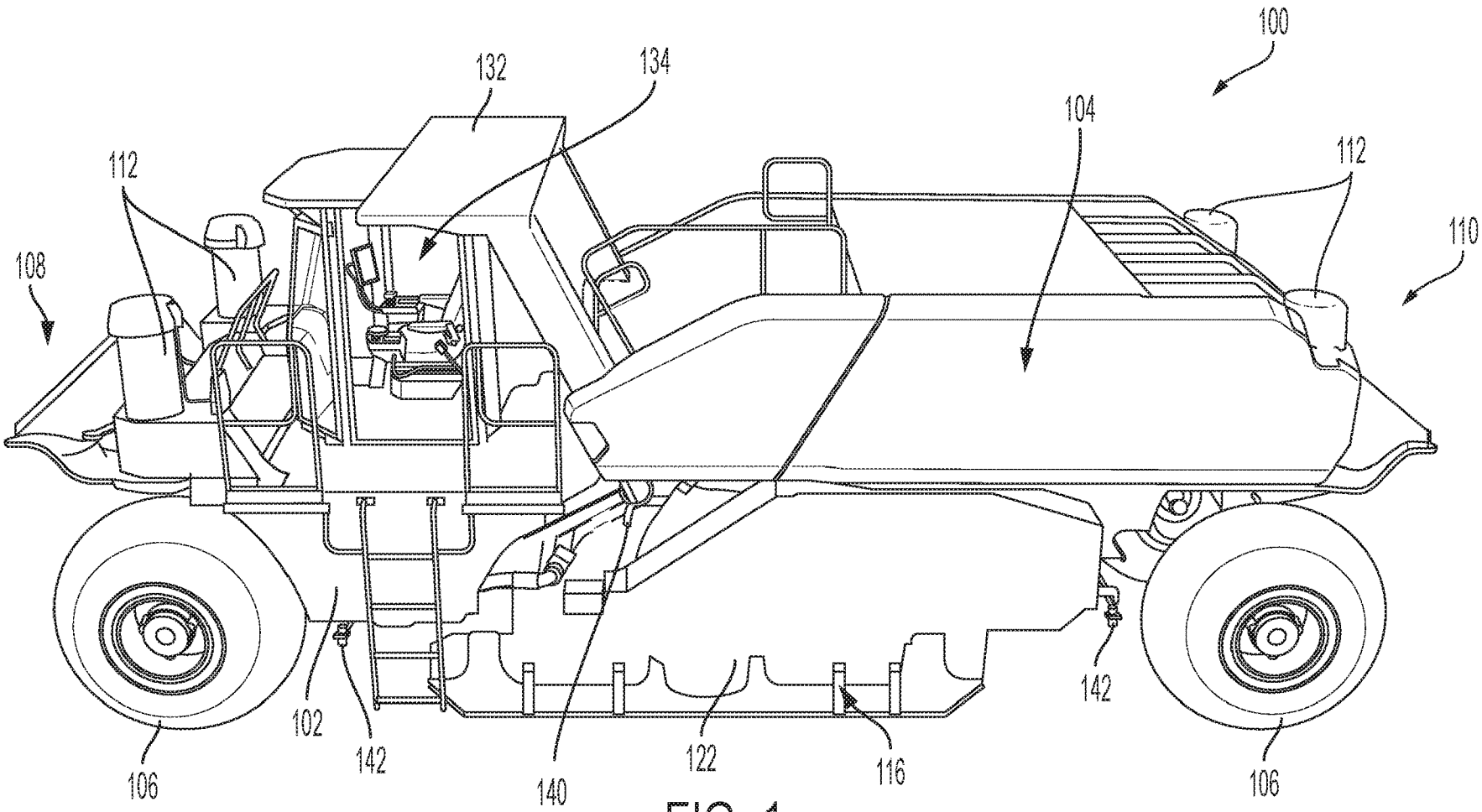
FIG. 1 is a side perspective view of a milling machine according to one or more embodiments of the disclosed subject matter.

Referring now to the drawings, FIG. 1 is a side perspective view of a milling machine 100 according to one or more embodiments of the disclosed subject matter. The milling machine 100 of FIG. 1 is a rotary mixer. Generally, rotary mixers can be used to pulverize a ground surface, such as roadways based on asphalt, and mix a resulting pulverized layer with an underlying base, to stabilize the ground surface. Rotary mixers may also be used as a soil stabilizer to cut, mix, pulverize, and stabilize a soil surface, for instance, to attain a strengthened soil base. Optionally, rotary mixers may add asphalt emulsions or other binding agents during pulverization to create a reclaimed surface. Though the milling machine 100 is shown as a rotary mixer, other machines for road reclamation, soil stabilization, surface pulverization, or other applications may be implemented according to embodiments of the disclosed subject matter, such as cold planers.

The milling machine 100 can include a frame 102, an engine 104 supported on the frame 102, and one or more ground engaging units or traction devices 106. The traction devices 106 can be operatively coupled to the engine 104 by a transmission mechanism (not shown) to drive the traction devices 106 and propel the milling machine 100. Although, the traction devices 106 are shown as wheels (with tires), the traction devices 106 may alternatively be tracks, or a combination of both tracks and wheels, according to embodiments of the disclosed subject matter.

The frame 102 can include a front portion 108 and a rear portion 110, where lifting columns 112 can be provided at the front portion 108 and the rear portion 110, such as shown in FIG. 1. Generally, the lifting columns 112, which may also be referred to herein as legs 112 of the milling machine 100, can couple the traction devices 106 to the frame 102.

The legs 112 can be controlled to allow adjustment of a height, a grade, and/or a slope of the frame 102 relative to a ground surface, for instance. That is, the legs 112 can be moved up or down, independently or together (e.g., in pairs or all together), by way of respective actuators, to adjust the height, the grade, and/or the slope of the frame 102. Accordingly, the frame 102 can be adjusted relative to the ground surface. In an embodiment, the legs 112 may be actuated hydraulically. Optionally, each leg 112 can include a sensor to sense or detect height thereof (and hence associated height of the corresponding portion of the frame 102). For instance, each leg 112 can include an in-cylinder position sensor to sense or detect height-related positioning of the leg 112.

The milling machine 100 can also be comprised of a milling or mixing chamber 116. Optionally, the mixing chamber 116 may be considered part of the frame 102, since the mixing chamber 116 and the frame 102 can be adjusted together based on the up/down movement of the legs 112. The mixing chamber 116 can be located proximate to or at a center portion of the milling machine 100, such as shown in FIG. 1.

Figure 2:
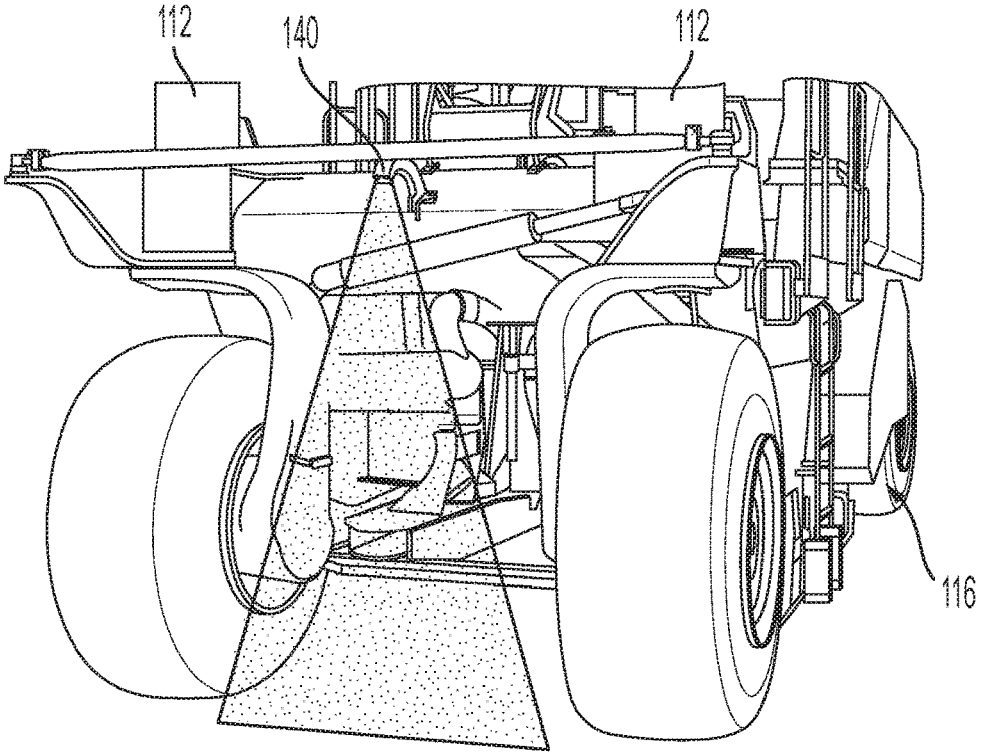
FIG. 2 is a front view of a portion of the milling machine of FIG. 1.
Figure 3:
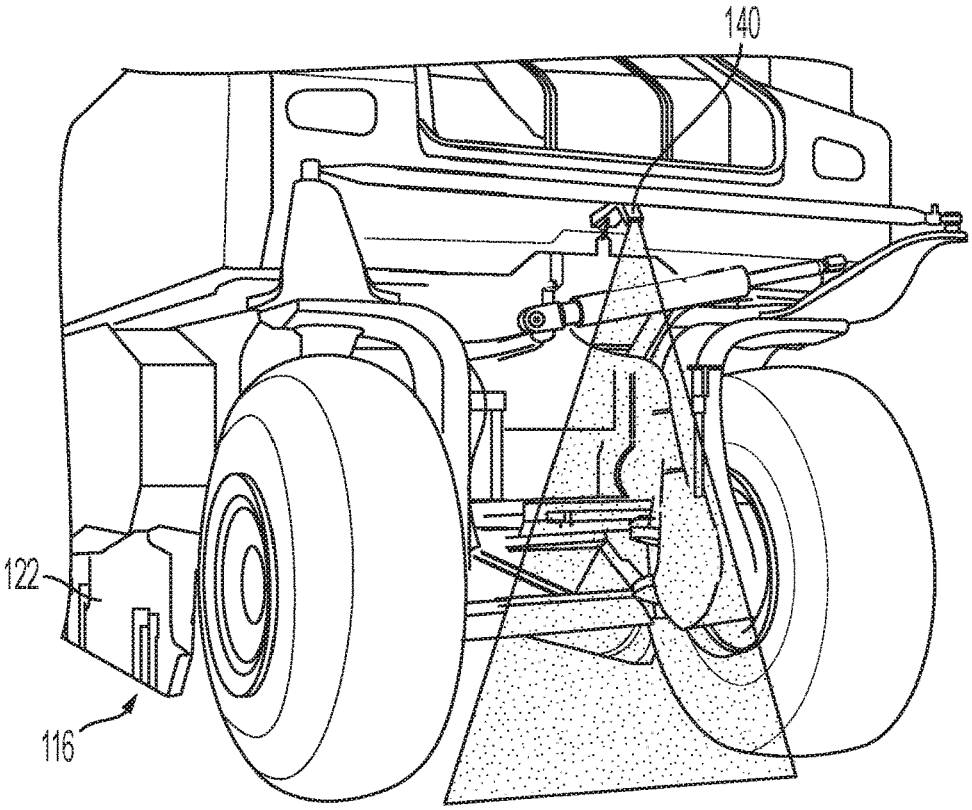
FIG. 3 is a rear view of a portion of the milling machine of FIG. 1.
Figure 4:
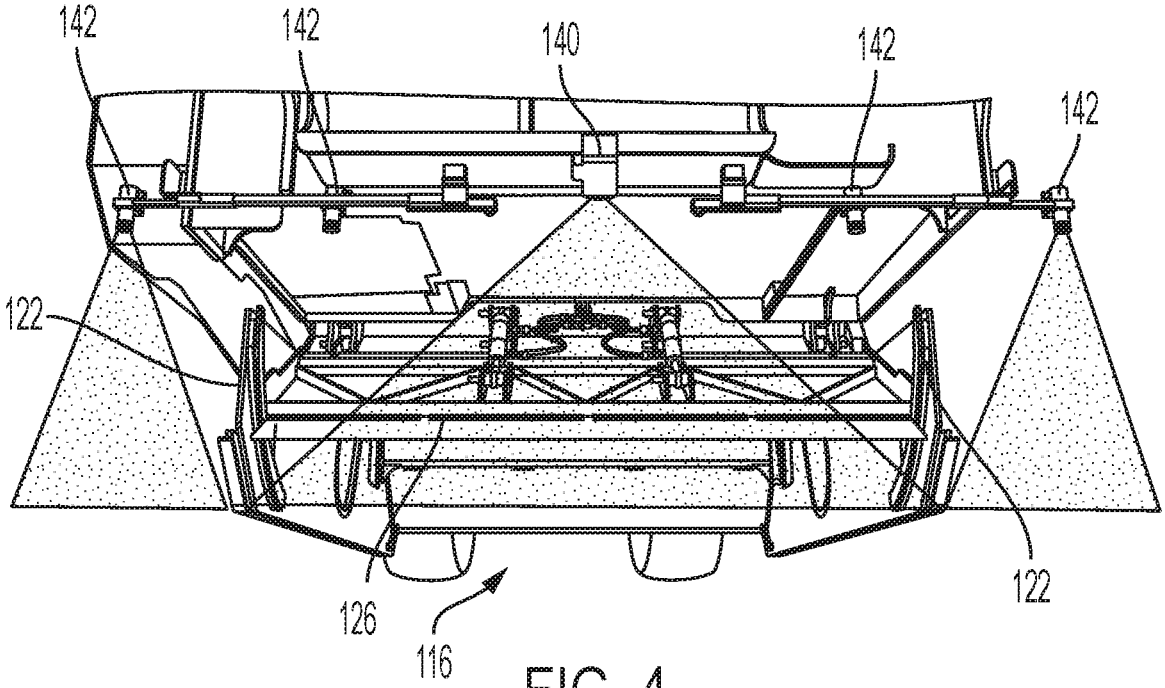
FIG. 4 is a rear view of a mixing chamber of the milling machine of FIG. 1.

As shown in FIGS. 1-7, the mixing chamber 116 can have a pair of opposing side plates 122, a front door 124 (in FIG. 5), and a rear door 126 (in FIG. 4). During a working operation (e.g., cutting, milling, mixing, etc.) the milling machine 100 can processes material and the side plates 122 may expand and contract and may be viewed as flowing on and within the material. A rotor 118 can be provided in the mixing chamber 116, either partially or fully depending upon a mode or operation of the milling machine 100.

Figure 7:
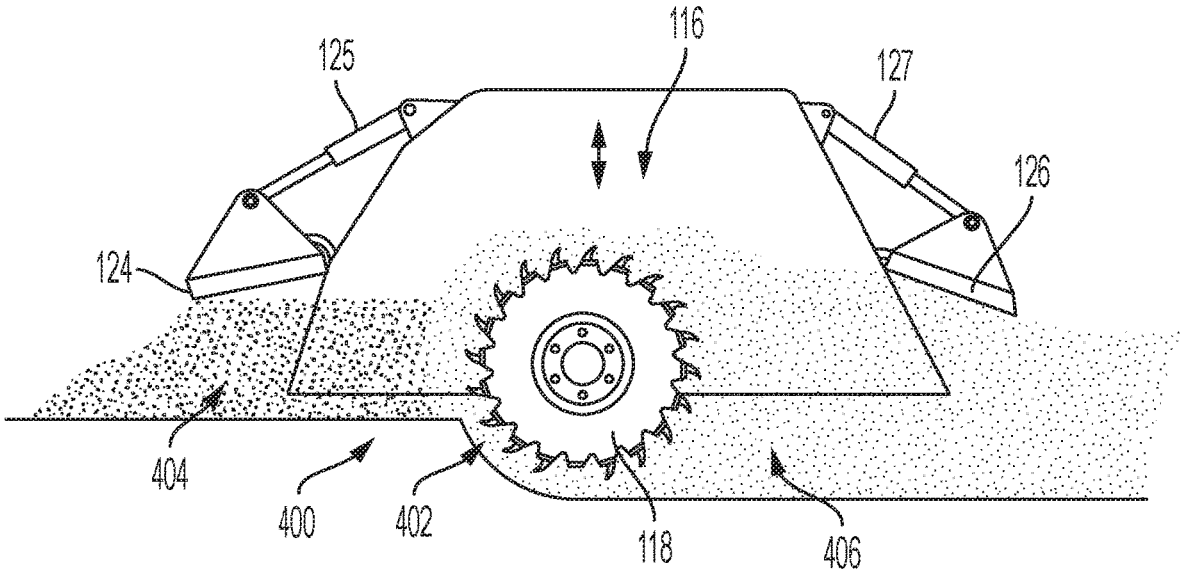
FIG. 7 shows an example of the mixing chamber of FIG. 6 in a second state of operation of the milling machine according to one or more embodiments of the disclosed subject matter.

The rotor 118 can be controlled to rotate so as to break and pulverize a surface layer 400 of the ground surface, such as diagrammatically shown in FIG. 7. Optionally, feed material 404 can be provided for mixing with the pulverized surface layer 400. The rotor 118 may also be moved vertically (i.e., up and down) within the mixing chamber 116, via one or more actuators (not expressly shown), between a fully extended position and a fully retracted position. The rotor 118 can be moved vertically independent of the movement of the legs 112. That is, according to embodiments of the disclosed subject matter, the rotor 118 can be controlled to move vertically without moving any, all, or some of the legs 112, some or all of the legs 112 can be controlled to move without vertical movement of the rotor 118, or the rotor 118 can be controlled to move vertically at the same time as movement of some or all of the legs 112.

Figure 6:
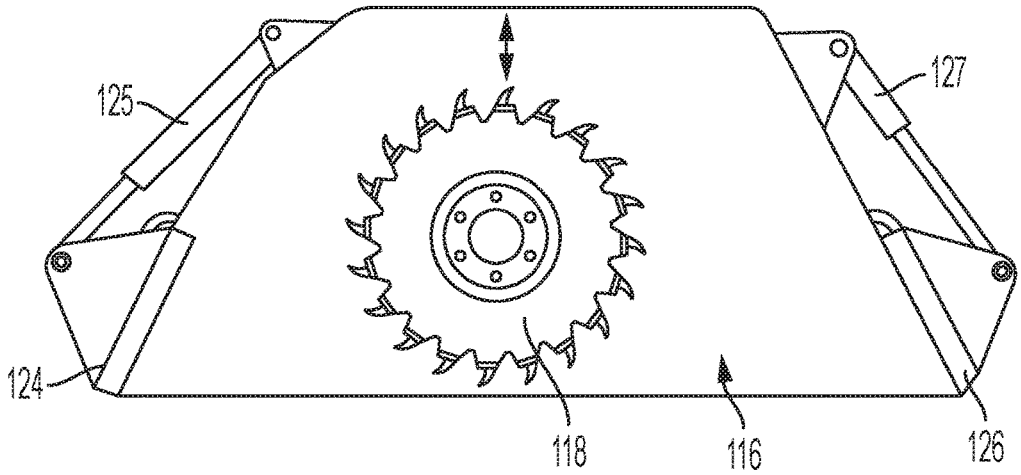
FIG. 6 shows an example of a mixing chamber of a milling machine in a first state of operation of the milling machine according to one or more embodiments of the disclosed subject matter.

FIG. 6 may be representative of the rotor 118 in the fully retracted position, and FIG. 7 may be representative of the rotor 118 in the fully extended position. Optionally, the fully retracted position may be called or characterized as a travel or stow position, and the fully extended position may be called or characterized as a working position (or cutting, or mixing, or milling position). Thus, FIG. 7 may also be representative of the rotor 118 in a cutting position, though the cutting position is not necessarily always at the fully extended position. In the cutting position the rotor 118 can extend below the surface layer 400 to cut the surface layer 400 according to a predetermined cutting depth. As noted above, the rotor 118 may also mix feed material 404 with the pulverized surface layer 400. In any case, with or without the feed material 404, operation of the rotor 118 can produce a resultant material 406.

A sensor may be provided in association with the rotor 118 or a portion thereof (e.g., each of one or more actuators thereof) to determine vertical positioning or height of the rotor 118. Such vertical positioning or height of the rotor 118 may be relative to a characteristic of the milling machine 100, such as an amount by which the rotor 118 projects from the bottom of the mixing chamber 116. Such vertical positioning or height of the rotor 118 may also be relative to the ground surface, for instance, the surface layer 400 of the ground surface.

The front door 124 can be located at a front end of the mixing chamber 116, and the rear door 126 can be positioned at a rear end of the mixing chamber 116. An actuator 125 can be operatively coupled to the first door 124 to open and close the front door 124. The actuator 125 can be controlled to set the front door 124 in a locked state or a floating state. Likewise, an actuator 127 can be operatively coupled to the rear door 126 to open and close the rear door 126. The actuator 127 can be controlled to set the rear door 126 in a locked state or a floating state.

The front door 124, when open, can allow entry of feed material 404 into the mixing chamber 116 (in a case that the milling machine 100 is moving forward). Positioning of the front door 124 can affect a degree of pulverization and/or mixing by regulating an amount, direction, and speed of a material flow of the feed material 404 into the mixing chamber 116. The rear door 126, whether open in the locked state or the floating state (also in the case that the milling machine 100 is moving forward), can allow exit of pulverized and/or mixed resultant material 406 to form a pulverized surface. The positioning of the rear door 126 can affect the degree of pulverization and/or compactness by regulating the amount and direction of the material flow through the mixing chamber 116.

An operator control station 132 can also be supported on the frame 102. The operator control station 132 can include a variety of components and controls to operate the milling machine 100, generally referred to in FIG. 1 as an operator control interface 134. The operator control interface 134 can include a steering system (e.g., a steering wheel, joystick, lever, etc.), a transmission control system, a speed control system for the milling machine 100, one or more displays, and a milling control interface. The milling control interface can have one or more of an operator control button, a toggle switch, a touch panel (e.g., of the one or more displays), a rotary switch, a radial dial, a switch, etc.

The operator control interface 134 can receive inputs from an operator of the milling machine 100 to control various operations of the milling machine 100. Such operations can include controlling a speed of the milling machine 100, a direction of the milling machine 100 (i.e., forward or backward), and milling-related operations, such as a return to cut operation, a cutting operation, and/or an exit cut operation.

The operator control interface 134, for instance, the milling control interface thereof, can also be used to receive settings from the operator for the milling-related operations such as those discussed above. For instance, the operator control interface 134 can receive inputs to control or set engine speed, rotor speed, frame height (via legs 112), rotor height of the rotor 118 (via vertical movement of the rotor 118 and/or movement of the legs 112), front door 124 positioning and/or state, rear door 126 positioning and/or state, rotor raise or lower speed of the rotor 118, raise or lower speed of the frame 102, etc., as non-limiting examples of settings for milling-related operations.

The operator control interface 134 can also receive an input from the operator to capture and save (discussed in more detail below) current settings for a milling-related operation, such as current cutting settings, for later retrieval so the milling machine 100 can be set to the same settings as before or perform an operation in the same way as before. Optionally, the operator control interface 134 can receive a single input from the operator to capture and save the current settings. Such settings, optionally, may be provided (e.g., displayed) to the operator and selectable, via the operator control interface 134, as a list of "favorites" in association with particular milling-related operations.

As shown in FIGS. 1-5, the milling machine 100 can also include a plurality of sensors (though one or more embodiments may include only one, some or more than the sensors shown). One or more of the sensors can be in the form of image sensors (e.g., cameras) 140. Additionally or alternatively, one or more sensors can be in the form of sonic sensors 142. The milling machine 100 of FIGS. 1-5, for instance, shows a combination of multiple image sensors 140 and multiple sonic sensors 142. Optionally, sensors in the form of lasers can be provided or substituted, for instance, for some or all of the sonic sensors 142.

Figure 5:
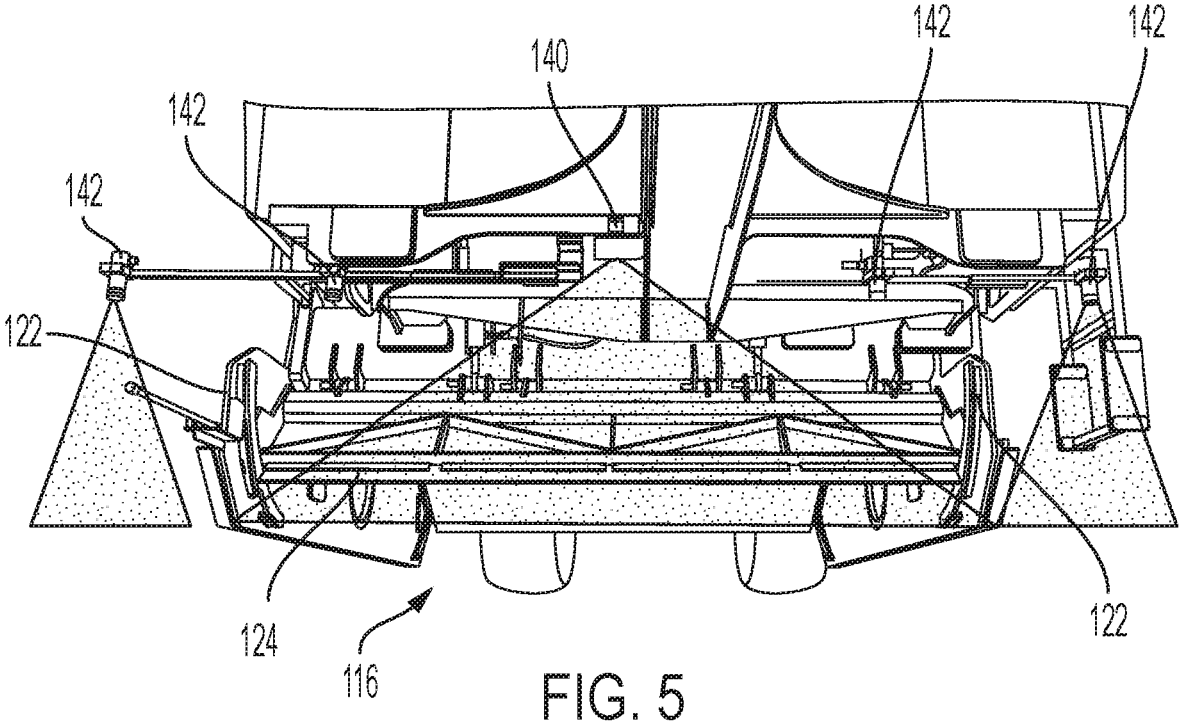
FIG. 5 is a front view of the mixing chamber of the milling machine of FIG. 1.

As a non-limiting example, the milling machine 100 can have, at one or more sides thereof, a side image sensor 140, such as shown in FIG. 1; a front image sensor 140, such as shown in FIG. 2; a rear image sensor 140, such as shown in FIG. 3; the image sensor 140 provided at a rear side of the mixing chamber 116, such as shown in FIG. 4; and the image sensor 140 provided at the front side of the mixing chamber 116, such as shown in FIG. 5. Each of the image sensors 140 can be configured to capture images, for instance, images corresponding to the ground surface (e.g., a top surface thereof) and/or images corresponding to portions of the milling machine 100. The images can be processed to determine various heights of the milling machine 100, such as height of the frame 102, height of the mixing chamber 116, state or position of the front door 124 and/or the rear door 126, and/or height of the rotor 118, relative to the ground surface or other portions of the milling machine 100 (e.g., bottom of mixing chamber 116 relative to height of rotor 118). Such determinations can be used to control various components of the milling machine 100, such those discussed above, according to selected settings for the milling machine 100.

For instance, the side image sensor 140 of FIG. 1 can capture images of the bottom of the side plate 122 and the ground surface, where such images can be processed (discussed in more detail below) to determine height of the bottom of the mixing chamber 116 relative to the ground surface. The side image sensor 140 may alternatively be provided on the other side of the milling machine 100, or side image sensors 140 may be provided on each side of the milling machine 100. As noted above, the mixing chamber 116 may be considered part of the frame 102. Hence, the distance from the bottom of the side plate 122 to the ground surface may be characterized as a height of the frame 102. Such data may be used without the need to provide position sensors in the legs 112 or without having to process data from position sensors in the legs 112 in combination with the data from the sonic sensors 142 to determine height-related information for various portions of the frame 102.

As another example, the image sensors 140 respectively provided at the front and rear sides of the mixing chamber 116 can capture images of the front door 124 and the rear door 126, where such images can be processed to determine or control states of the front door 124 and the rear door 126. Such image sensors 140 may also capture images of or inside the mixing chamber 116 (depending upon the state and configuration of the front door 124 and the rear door 126). Such images can be processed to determine the distance of the bottom of the mixing chamber 116 and characteristics of the ground surface, such as the surface layer 400 and/or the resultant material 406. Images from inside the mixing chamber 116 may also capture positioning of the rotor 118 relative to surface layer 400 and/or a bottom of the mixing chamber 116.

As yet another example, the front image sensor 140 and the rear image sensor 140 can capture images of the ground surface at the front portion 108 and the rear portion 110 of the frame 102, respectively, and optionally portions of the milling machine 100 at the front portion 108 and the rear portion 110. Such images can be processed to determine height (or heights) of the frame 102 relative to the ground surface.

The milling machine 100 can have, as a non-limiting example, a plurality of sonic sensors 142 at the rear side of the mixing chamber 116, such as shown in FIG. 4, and a plurality of sonic sensors 142 at the front side of the mixing chamber 116, such as shown in FIG. 5. More or less than the number of sonic sensors 142 shown in FIG. 4 and FIG. 5 can be implemented, however. Such sonic sensors 142, which can be provided on the frame 102, can sense distance to the ground surface. Hence, data from the sonic sensors 142 can be processed to determine a height of the frame 102 (or heights of different portions of the frame) relative to the ground surface. Such data may be used without the need to provide position sensors in the legs 112 or without having to process data from position sensors in the legs 112 in combination with the data from the sonic sensors 142 to determine height-related information for various portions of the frame 102.

Figure 8:
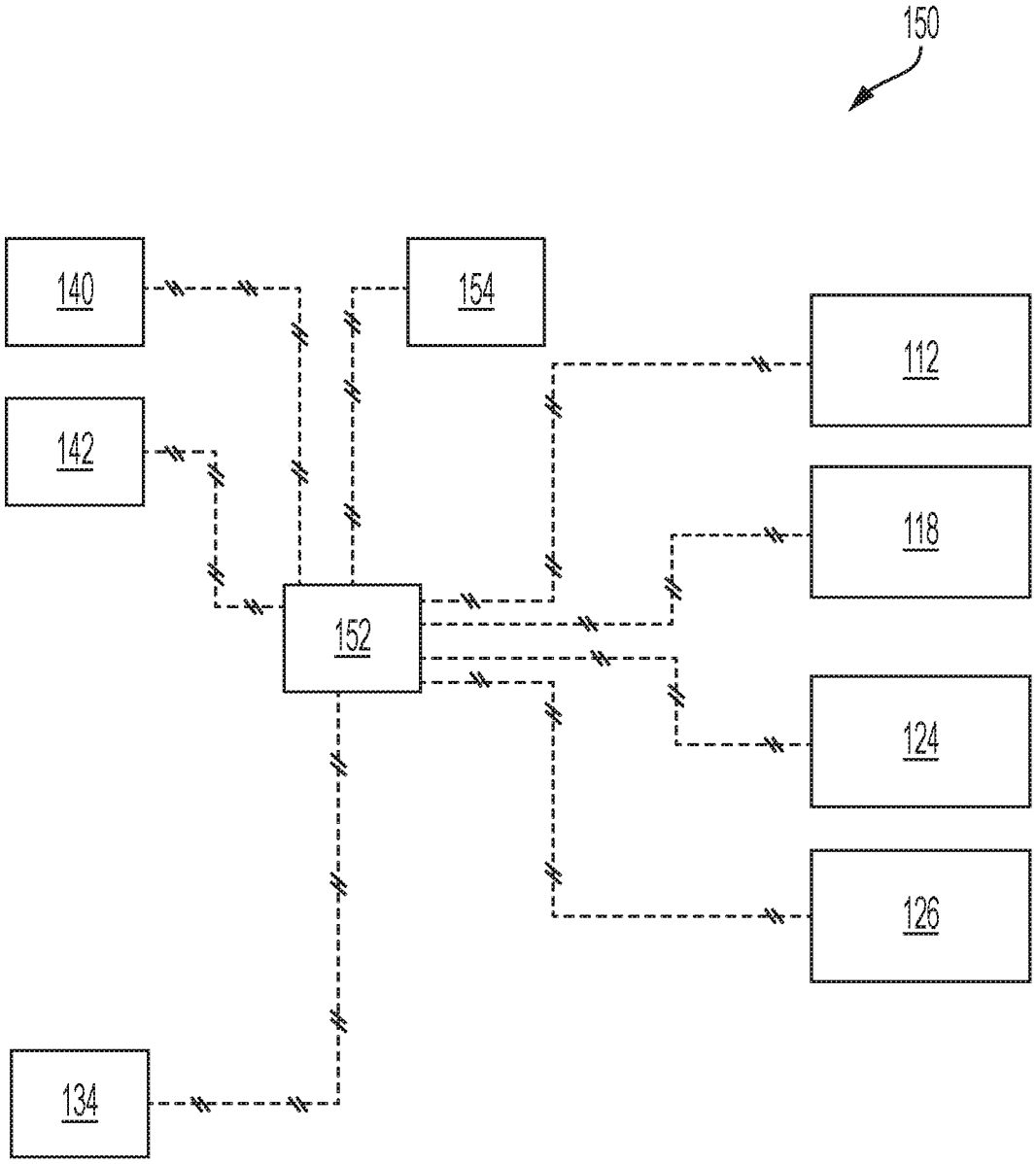
FIG. 8 illustrates a control system according to one or more embodiments of the disclosed subject matter.

FIG. 8 illustrates a control system 150 according to one or more embodiments of the disclosed subject matter. The control system 150 can be implemented on the milling machine 100 to control operation of the milling machine 100.

The control system 150 can include a controller or control circuitry 152, which may be or include a microprocessor or other processor or processing device configured to control a plurality of devices or systems of the milling machine 100. For example, in an embodiment the controller 152 may be an electronic control module (ECM) or multiple ECMs.

The controller 152 can be in communication with various components of the milling machine 100. For instance, FIG. 8 shows that the controller 152 can send control signals to control the legs 112, the rotor 118, the front door 124 of the mixing chamber 116, and the rear door 126 of the mixing chamber 116. Depending upon whether respective actuators of the foregoing components have their own position sensors or the like, the controller 152 can also receive signals from the foregoing components. Additionally or alternatively, the controller 152 can receive signals from the image sensor(s) 140 and the sonic sensor(s) 142. Such feedback from the image sensor(s) 140 and the sonic sensor(s) 142 can be used to control the legs 112, the rotor 118, the front door 124 of the mixing chamber 116, and the rear door 126 of the mixing chamber 116.

The controller 152 can also receive signals from the operator control interface 134. Such signals can correspond to operator control inputs to control the milling machine 100, to input settings for control of the milling machine 100, and to capture and record current settings of the milling machine 100 during milling-related operations, such as a cutting operation, a return to cut operation, and an exit cut operation.

For instance, the controller 152 can receive control signals from the operator control interface 134 in response to one or more operator control inputs to the operator control interface 134 to perform a return to cut operation or an exit cut operation. Optionally, each of the return to cut operation and the exit cut operation can be initiated and performed via a predetermined number of operator control inputs to the operator control interface 134. For instance, embodiments of the disclosed subject matter can implement a single operator control input to the operator control interface 134 (e.g. the operator only has to activate one button, lever, etc.) to perform either the return to cut operation or the exit cut operation. As another example, multiple operator control inputs (e.g., two) to the operator control interface 134 can be implemented for each of the return to cut operation and the exit cut operation, for instance, to initiate different phases of the particular operation.

Memory 154 may be provided, and may be accessed by the controller 152. Though memory 154 is shown in FIG. 8 as separate from the controller 152, according to one or more embodiments some or all of the memory 154 can be implemented within the controller 152. The memory 154 may include one or more storage devices configured to store information used by the controller 152 to perform operations to control the milling machine 100. For instance, memory 154 can store one or more operating programs for the controller 152. Thus, the memory 154, or portions thereof, may be characterized as a non-transitory computer-readable storage medium that stores computer-readable instructions which, when executed by a computer (e.g., a microprocessor of the controller 152), can cause the computer to control operations to control the milling machine 100, such as to perform the return to cut operation, the cutting operation, or the exit cut operation.

Optionally, the memory 154 can store settings for the milling machine 100. For instance, the memory 154 can store settings to configure components of the milling machine 100, such as the legs 112, the rotor 118, the front door 124, and/or the rear door 126, to perform particular operations, including the return to cut operation and/or the exit cut operation. Such settings may be entered (i.e., set) by the operator using the operator control interface 134, as noted above.

INDUSTRIAL APPLICABILITY

As noted above, the present disclosure relates to an automated exit cut operation of a milling machine, such as milling machine 100.

Generally, the rate at which the rotor 118 of the milling machine 100 is raised may impact material-related characteristics when the rotor 118 is raised, such as at the end of the cutting pass. Accordingly, embodiments of the disclosed subject matter can control the rate at which the rotor 118 is raised during an exit cut operation to prevent or minimize the impact that the raising rotor 118 may have on material-related characteristics. Material-related characteristics can include an undesirable divot and/or pile of material (e.g., an undesirably large divot and/or pile of material).

According to embodiments of the disclosed subject matter, for a particular job, worksite, or operator preference, certain setting configurations for the milling machine 100 can be implemented automatically responsive to one or more control inputs at the operator control interface 134. Moreover, such settings can be previously saved in memory 154 by the operator for later retrieval and implementation under the control of the controller 152 for a later (e.g., next or subsequent) same operation, such as the exit cut operation. Thus, for the later operation the milling machine 100 can be automatically configured, under control of the controller 152, without the operator having to enter in again (e.g., individually) the settings to revert the configuration of the milling machine 100 to prior settings. Optionally, embodiments of the disclosed subject matter can implement a save function, whereby the operator can operate the operator control interface 134 to capture and record current settings for a current milling-related operation, such as an exit cut operation. The operator can use the operator control interface 134 to retrieve the recorded settings to automatically set the settings of the milling machine 100 to the same settings when the operator wishes to perform the same corresponding milling-related operation in an effort to achieve the same or substantially similar results as the now-previous milling-related operation.

Figure 9:
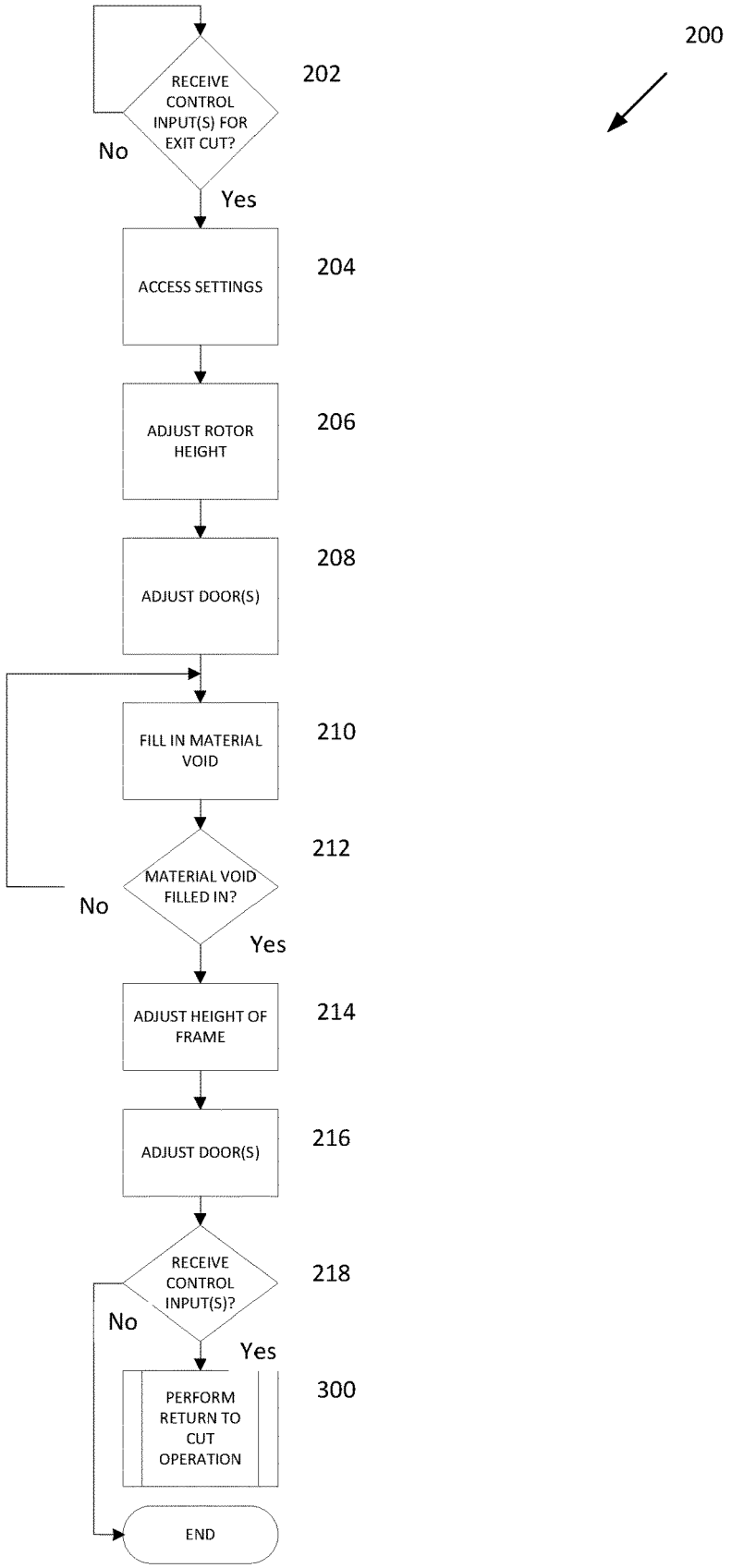
FIG. 9 is a flow chart of a method for an exit cut operation according to one or more embodiments of the disclosed subject matter.

FIG. 9 is a flow chart of a method 200 for an exit cut operation according to one or more embodiments of the disclosed subject matter. As noted above, the controller 152 can control the legs 112, the rotor 116, the front door 124, and the rear door 126 to perform the exit cut operation. And such control can be based on data from one or more sensors, such as data from the image sensor(s) 140 and/or the sonic sensor(s) 142.

At operation 202 the method 200 can involve determining whether a control input (or inputs) has been received to perform the exit cut operation. Such control input can be received at the operator control interface 134, and the controller 152 can monitor whether a control signal corresponding to the control input is received. The control input to initiate the exit cut operation at operation 202 can be received at the end of a cutting pass of the milling machine 100 or between a beginning and an end of the cutting pass of the milling machine 100. Thus, according to embodiments of the disclosed subject matter, the exit cut operation can separate two successive return to cut operations of a same cutting pass, or may separate successive return to cut operations of successive cutting passes of the milling machine 100.

At operation 204 the method 200 can access settings for the milling machine 100 to perform the exit cut operation. As noted above, such settings can be stored in the memory 154 and accessed by the controller 152. In that the exit cut operation can follow a return to cut operation, the exit cut operation may start from settings set for a most recent return to cut operation.

At operation 206 the height of the rotor 118 can be adjusted. For example, the height of the rotor 118 can be raised by controlling one or more actuators thereof (not expressly shown) operatively coupled to the rotor 118. Such adjustment can be relative to the ground, and can be from a cutting height for the rotor 118 toward a stow or travel height, such as shown in FIG. 6. The height of the rotor 118 can be adjusted independent of the adjustment of the frame 102. The adjustment of the height of the rotor 118 can be based on signals from a position sensor associated with the rotor 118, such as a position sensor of the corresponding actuator. Optionally, the adjustment of the height of the rotor 118 can be based on processing of data from one or more of the image sensors 140.

According to one or more embodiments, the rate at which the rotor 118 is raised can be based on the speed of travel of the milling machine 100. For instance, the rate at which the rotor 118 is raised can be proportional to the speed of travel of the milling machine 100, meaning, generally speaking, that the faster the milling machine 100 is traveling during the exit cut operation the faster the rotor 118 can be raised.

Optionally, according to embodiments of the disclosed subject matter, the rate at which the rotor 118 is raised can vary depending upon the height of the rotor 118 and/or the depth of the rotor 118 in the surface layer 400. For instance, the rate at which the rotor 118 is raised can increase as the rotor 118 is raised. Optionally, the rate at which the rotor 118 is raised can be at a maximum rate when the rotor 118 reaches the top surface of the surface layer 400 (or determined or estimated to have reached the top surface). Alternatively, the rate at which the rotor 118 is raised can be increased to the maximum rate when the bottom of the rotor 118 (or some other portion thereof) is determined or estimated to have reached the top surface of the surface layer 400. And according to one or more embodiments, the rate at which the rotor 118 is raised, for instance, initially raised from the cutting position, can be based on the depth of the rotor 118 in the surface layer 400.

One or more sensors, such as one or more of the image sensors 140 can be used to determine height- and/or depth-related information of the rotor 118, such as depth of the rotor 118 in the surface layer 400 and/or when the rotor 118 has reached the top surface of the surface layer 400. For instance, image data from the one or more of the image sensors 140, which can be representative of an interface or interfaces with the rotor 118 and the surface layer 400, can be processed by the controller 152 to determine the depth of the rotor 118 in the surface layer 400 and/or when the rotor 118 has reached the top surface of the surface layer 400.

Figure 10:
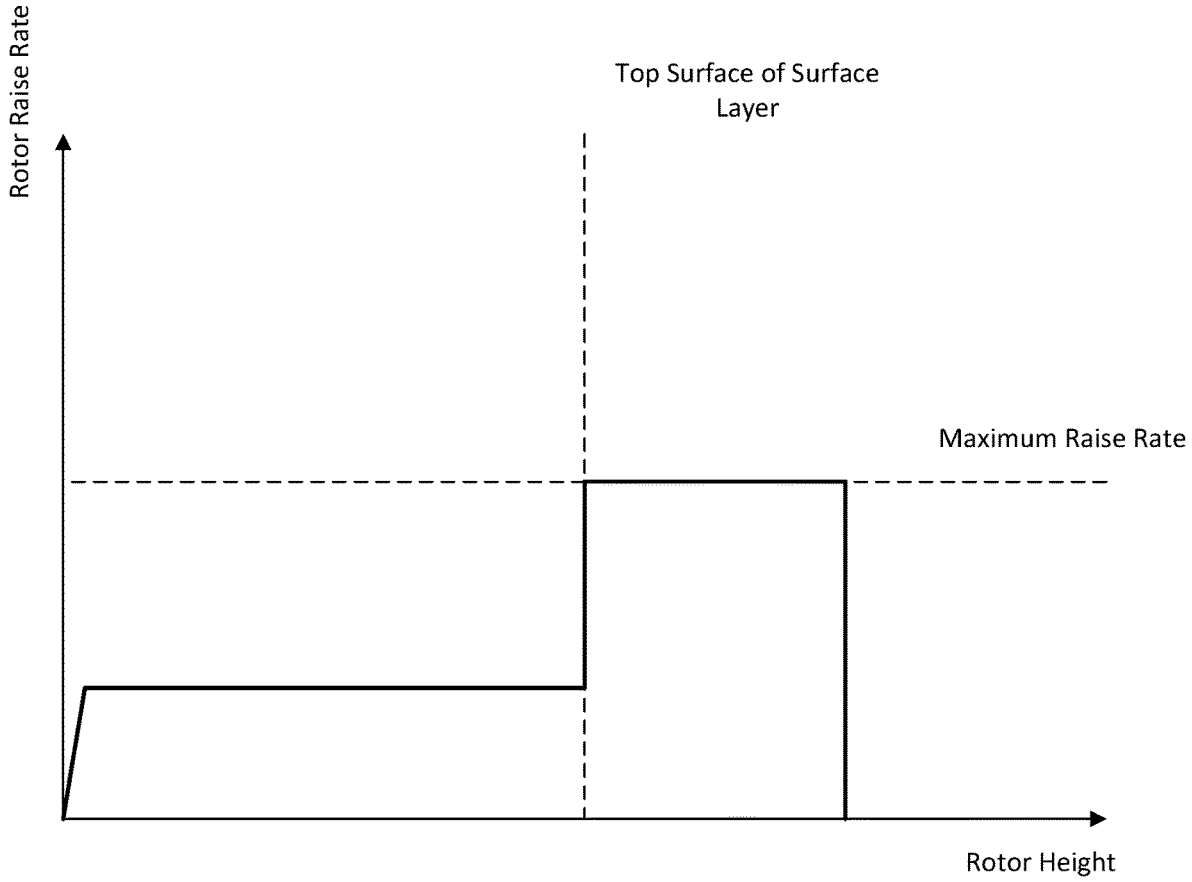
FIG. 10 is a graph of rotor height versus rotor raise rate during an exit cut operation according to one or more embodiments of the disclosed subject matter.

FIG. 10, for instance, is a graph showing height of the rotor 118 versus rotor raise rate during an exit cut operation according to embodiments of the disclosed subject matter. Optionally, height of the rotor 118 may be substituted by inverse depth of the rotor 118 relative to the surface layer 400. Rotor height or rotor depth may be interpreted as starting from a current cutting height or depth of the rotor 118, as set forth in a current cutting operation or a previous return to cut operation.

As shown in FIG. 10, upon initiation of the exit cut operation (at the y-axis) the rotor 118 can be raised, as an example, after an initial increase at startup, essentially at a constant rate until the rotor 118 reaches the top surface of the surface layer 400. Once the rotor 118 has reached the top surface of the surface layer 400 (e.g., the rotor 118 is first completely above the top surface of the surface layer 400), the speed at which the rotor 118 is raised can be increased to a maximum value. The rotor 118 may continue to be raised at the maximum rate until the rotor reaches a predetermined height, such as a travel or stow height of the rotor 118. Though FIG. 10 shows the rotor raise rate being reduced from the maximum raise rate very quickly, for instance, at the travel or stow height, optionally the raise rate may taper down or be less drastic as the rotor 118 approaches the travel or stow height.

Figure 11:
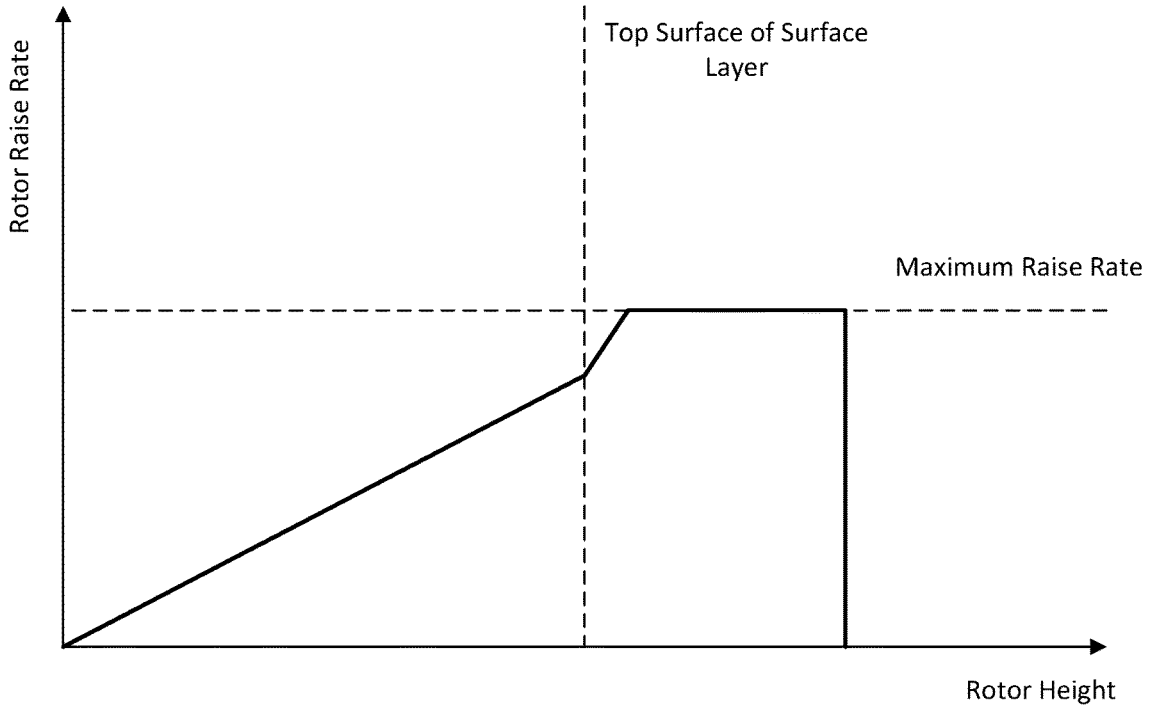
FIG. 11 is another graph of rotor height versus rotor raise rate during an exit cut operation according to one or more embodiments of the disclosed subject matter.

FIG. 11 shows another graph of height of the rotor 118 versus rotor raise rate during an exit cut operation according to embodiments of the disclosed subject matter. As noted above, height of the rotor 118 may be substituted by inverse depth of the rotor 118 relative to the surface layer 400.

According to FIG. 11, upon initiation of the exit cut operation (at the y-axis) the rotor 118 can be raised, as an example, at a linearly increasing rate. Upon reaching the top surface of the surface layer 400 (e.g., the rotor 118 is first completely above the top surface of the surface layer 400), the speed at which the rotor 118 is raised can be increased to a maximum value. The rotor 118 may continue to be raised at the maximum rate until the rotor reaches a predetermined height, such as a travel or stow height of the rotor 118. Though FIG. 11 shows the rotor raise rate being reduced from the maximum raise rate very quickly, for instance, at the travel or stow height, optionally the raise rate may taper down or be less drastic as the rotor 118 approaches the travel or stow height.

Though FIG. 11, for instance, shows the rate of raising the rotor 118 increasing linearly prior to and after reaching the top surface of the surface layer 400, embodiments of the disclosed subject matter are not so limited. Thus, the rate at which the rotor 118 is raised can be non-linear prior to and/or after reaching the top surface of the surface layer 400. Moreover, according to one or more embodiments, the rate at which the rotor 118 is raised may be controlled to be initially at the maximum raise rate at the same time the rotor 118 (e.g., bottom portion of rotor 118) first reaches the top surface of the surface layer 400. Such control may be based on a prediction, using the controller 152 and data from one or more sensors of the milling machine 100, such as one or more sensors 140 and/or one or more sensors 142.

At operation 208 the front door 124 and/or the rear door 126 can be adjusted. Optionally, the front door 124 and/or the rear door 126 can be adjusted as the rotor 118 is being raised. Moreover, adjustment of the front door 124 and/or the rear door 126 can be from respective states set during the preceding return to cut operation or cutting operation and, furthermore, can be based on the direction of travel of the milling machine 100. Thus, the front door 124 and the rear door 126 may be adjusted from respective open positions (though not necessarily open by the same amount).

The adjustment of the front door 124 and/or the rear door 126 of operation 308 may, optionally, be to fill in a material void 402 that may be caused, created, or left by the raising of the rotor 118. To be clear, filling in the material void 402 may not be implemented, as the material void 402 may not need to be filled in because the material void 402 is not problematic, has acceptable characteristics, or is not present in as far as the surface geometry of the ground material may not be characterized as a material void.

As noted above, the adjustment of the front door 124 and/or the rear door 126 may be based on the direction of travel of the milling machine 100. For instance, when the milling machine 100 is moving forward the front door 124 can be controlled to remain open or open more and the rear door 126 can be set to the floating state (if not already in the floating state) or to close by a certain amount (e.g., but not entirely closed). Thus, the rear door 126 can be used to fill in the material void 402 when the milling machine 100 is moving forward. And when the milling machine 100 is moving backward the rear door 126 can be controlled to remain open or open more and the front door 124 can be set to the floating state or to close by a certain amount (e.g., but not entirely closed). Thus, the front door 124 can be used to fill in the material void 402 when the milling machine 100 is moving backward. As noted above, in the floating state the floating door, whether the front door 124 or the rear door 126, can provide a down pressure. In the case of the rear door 126, such down pressure may be different from the down pressure set for the return to cut operation.

The adjustment of the front door 124 and/or the rear door 126 can be based on signals from one or more of the image sensors 140 and/or one or more of the sonic sensors 142. For instance, data from the image sensor(s) 140 and/or the sonic sensor(s) 142, particularly those at the front and rear of the mixing chamber 116, can be processed, using the controller 152, to determine positioning of the front door 124 and/or the rear door 126 (e.g., open, closed, amount open, moving, etc.). The processing can also involve determining when the front door 124 and/or the rear door 126 have reached the desired state.

Operation 210 can represent a process of filling in the material void 402. Such operation 210 can be performed based on the settings of the front door 124 and the rear door 126, as well as based on the speed of travel of the milling machine 100 and the rate at which the rotor 118 is raised. Generally, filling in the material void 402 can involve whichever of the front door 124 or the rear door 126 is to fill in the material void 402, depending upon the direction of travel of the milling machine 100, can direct the resultant material 406 so as to fill in the material void 402 as the milling machine 100 moves in the forward or backward direction of travel as the case may be. As noted above, operation 210 may be optional or not implemented in one or more embodiments of the disclosed subject matter.

At operation 212 the method 200 can determine whether the material void 402 has been satisfactorily filled in. Such determination can be based on data from one or more of the image sensors 140 and/or one or more of the sonic sensors 142. For instance, such data may be processed automatically using the controller 152 to determine whether the material void 402 has been satisfactorily filled in. Similar to above, operation 212 may be optional or not implemented in one or more embodiments of the disclosed subject matter.

As but one example, the image sensor(s) 140 may be used to capture data corresponding to the start of an exit cut and the current position of the milling machine 100, where such data can be used by the controller 152 to calculate a distance travelled since the start of the exit cut operation. Based on the settings of the milling machine 100 a certain distance may be indicative that the material void 402 has been filled in. Thus, determination that the milling machine 100 has traveled a certain distance may be used as an indication that the material void 402 has been filled in.

According to another example, image data from the image sensor(s) 140 at the front and/or rear of the mixing chamber 116, depending upon the direction and distance of travel, can be processed using the controller 152 to determine whether the material void 402 has been filled in. Optionally, such determining can be based on machine learning and training using images of suitably filled in material voids 402. Likewise, the sonic sensor(s) 142 at the front of the mixing chamber 116 and/or at the rear of the mixing chamber 116 may be representative of whether the material void 402 has been filled in and may be processed using the controller 152 to determine whether and when the material void 402 has been filled in.

Optionally, image data from the image sensor(s) 140, for instance an image sensor 140 at the rear side of the mixing chamber 116, may be provided to the operator, via one or more displays of the operator control interface 134, for the operator to visually determine whether the material void 402 has been satisfactorily filled in.

At operation 214 the height of the frame 102 can be adjusted. Though FIG. 9 shows that the height of the frame 102 is adjusted after the operation 212 to determine whether the material void 402 is filled in, optionally, the height of the frame 102 may begin to be adjusted before the final determination that the material void 402 has been filled in, though typically a predetermined amount of time after the initiation of the operation 210 to fill in the material void 402.

Optionally, the height of the frame 102 may begin being adjusted as soon as the height of the rotor 118 reaches the top surface of the surface layer 400 as discussed above for operation 206. And to be clear, according to embodiments of the disclosed subject matter, the operations 210 and 212 may be optional, meaning that operation 206 to adjust the height of the rotor 118 may be performed without performing the operations 210 and 212 to fill in the material void 402.

According to one or more embodiments, operation 214 can be initiated by a control input provided to the operator control interface 134. Alternatively, the operation 214 can be performed automatically, for instance, responsive to a determination that the rotor 118 has reached a predetermined height, such as reaching the top surface of the surface layer 400.

The height of the frame 102 can be raised by controlling one or more of the legs 112, such as all of the legs 112. Such height adjustment can be relative to the ground surface, and can be to a travel or non-cutting height. Such adjustment can also adjust (e.g., raise) the height of the rotor 118. The adjustment of the height of the frame 102 can be based on signals from one or more of the image sensors 140 and/or one or more of the sonic sensors 142. For instance, data from the image sensor(s) 140 and/or the sonic sensor(s) 142 can be processed to determine height of the frame 102 relative to the ground surface and/or height of the mixing chamber 116 relative to the ground surface. In that the front door 124 and the rear door 126 can be operatively coupled to the mixing chamber 116, the rate at which the frame 102 (and hence the mixing chamber 116) is raised can determine how the material void 402 gets filled in (e.g., how quickly, how much, patterning, etc.). Optionally, the rate at which the frame 102 is raised can be steady or linear, which may better ensure that the material void 402 is filled in with material having a suitable surface (e.g., grade, uniformity, etc.).

At operation 216 the front door 124 and/or the rear door 126 can be adjusted, particularly in a case where the operation 210 and 212 were performed to fill in the material void 402. Such adjustment may be to a travel or stow position, which may be fully or partially closed. Though operation 216 is shown after operation 214, operation 216 may start during operation 214, for instance, at the same time at which operation 214 starts or after a predetermined amount of time after operation 214 starts.

At operation 218 the method 200 may determine whether another control input is received, such as a control input to perform a return to cut operation 300. If another control input is received to perform the return to cut operation the method 200 can proceed to method 300, otherwise the exit cut operation can end.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A milling machine comprising:

an operator control interface;

a frame;

a mixing chamber;

a rotor configured to process ground surface material, the rotor being provided at least partially in the mixing chamber;

a plurality of sensors; and a controller configured to control a plurality of legs of the milling machine and the rotor according to settings for an automated exit cut operation, wherein the controller is configured to:

control the automated exit cut operation responsive to a control input at the operator control interface, the automated exit cut operation including raising the rotor to be fully inside the mixing chamber based on a speed of the milling machine, determine when the rotor has reached a top surface of the ground surface material based on signals from at least sensor of the plurality of sensors, and control the raising of the rotor such that the rotor is raised at a rate proportional to the speed of the milling machine, the rate at which the rotor is raised increasing as the rotor is raised, and the rotor being raised at a maximum rate when the controller determines that the rotor has reached the top surface of the ground surface material.

2. The milling machine according to claim 1, wherein the plurality of sensors include a plurality of sonic sensors and/or a plurality of image sensors.

3. The milling machine according to claim 1, wherein the plurality of sensors includes at least one sensor to sense a height of one or more side plates of the mixing chamber or at least one sensor to sense a height of the frame.

4. The milling machine according to claim 1, wherein the controller is configured to initiate raising the legs of the milling machine, as part of the automated exit cut operation, when the controller determines that the rotor has reached the top surface of the ground surface material.

5. The milling machine according to claim 4, wherein the control input at the operator control interface is a single push button to initiate the exit cut operation.

6. The milling machine according to claim 1, wherein the controller is configured to configure respective states of a front door and a rear door of the mixing chamber of the milling machine, as part of the automated exit cut operation, based on direction of travel of the milling machine, to fill in a ground surface material void associated with the raising of the rotor, and wherein when the milling machine is moving forward the front door is controlled to be open and the rear door is set to a floating state, and when the milling machine is moving backward the rear door is controlled to be open and the front door is set to the floating state.

7. A milling system comprising:

a rotor of a milling machine configured to process ground surface material;

a mixing chamber of the milling machine, the rotor being provided at least partially in the mixing chamber; and a controller of the milling machine configured to control an automated exit cut operation, wherein the controller is configured to:

control the exit cut operation responsive to a control input at an operator control interface of the milling machine, the exit cut operation including raising the rotor from a state where the rotor contacts the ground surface material to a state where the rotor does not contact the ground surface material, determine when the rotor has reached a top surface of the ground surface material based on signals from at least one sensor, and control the raising of the rotor such that a rate at which the rotor is raised increases as the rotor is raised, the rotor being raised at a maximum rate when the controller determines that the rotor has reached the top surface of the ground surface material.

8. The milling system according to claim 7, wherein the rate at which the controller raises the rotor is based on a speed of the milling machine.

9. The milling system according to claim 7, wherein each said at least one sensor is either a sonic sensor or a camera.

10. The milling system according to claim 7, wherein the controller is configured to initiate raising legs of the milling machine, as part of the exit cut operation, when the controller determines that the rotor has reached the top surface of the ground surface material.

11. The milling system according to claim 10, wherein the initiation of the raising of the legs is performed responsive to a second control input at the operator control interface.

12. The milling system according to claim 7, wherein the controller is configured to configure respective states of a front door and a rear door of the mixing chamber of the milling machine, as part of the exit cut operation, based on direction of travel of the milling machine, to fill in a material void associated with the raising of the rotor, and wherein when the milling machine is moving forward the front door is controlled to be open and the rear door is set to a floating state, and when the milling machine is moving backward the rear door is controlled to be open and the front door is set to the floating state.

13. The milling system according to claim 7, wherein the controller is configured to determine whether a ground surface material void has been filled in based on data from the at least one sensor.

14. A method comprising:

raising, under control of control circuitry, a rotor of a milling machine from a state where the rotor contacts ground surface material responsive to a control input at an operator control interface of the milling machine;

determining, using the control circuitry, when a bottom portion of the rotor has reached a top surface of the ground surface material based on signals from at least one sensor; and controlling, using the control circuitry, the raising of the rotor such that a rate at which the rotor is raised increases as the rotor is raised, wherein the rate at which the rotor is raised increases to a maximum rate when said determining determines that the bottom portion of the rotor has reached the top surface of the ground surface material.

15. The method according to claim 14, wherein the rate at which the rotor is raised to when the bottom portion of the rotor reaches the top surface of the ground surface material is based on a speed of the milling machine.

16. The method according to claim 14, wherein each said at least one sensor is either a sonic sensor or a camera.

17. The method according to claim 14, further comprising initiating raising legs of the milling machine, using the control circuitry, responsive to when said determining determines that the bottom portion of the rotor has reached the top surface of the ground surface material.

18. The method according to claim 17, wherein said initiating the raising of the legs is performed responsive to a second control input at the operator control interface.

19. The method according to claim 14, further comprising configuring respective states of a front door and a rear door of a mixing chamber of the milling machine, using the control circuitry, based on direction of travel of the milling machine, to fill in a ground surface material void associated with the raising of the rotor.

20. The method according to claim 14, further comprising determining whether a ground surface material void has been filled in based on data from the at least one sensor.

* * * * *